US011296446B2

(12) United States Patent
Raybold

(10) Patent No.: US 11,296,446 B2
(45) Date of Patent: Apr. 5, 2022

(54) CONNECTOR FOR A FLAT FLEXIBLE CABLE

(71) Applicant: TE Connectivity Services GmbH, Schaffhausen (CH)

(72) Inventor: Christopher Ryan Raybold, Middletown, PA (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 16/919,801

(22) Filed: Jul. 2, 2020

(65) Prior Publication Data

US 2022/0006219 A1 Jan. 6, 2022

(51) Int. Cl.
*H01R 12/78* (2011.01)
*H01R 13/05* (2006.01)

(52) U.S. Cl.
CPC ..... *H01R 12/78* (2013.01); *H01R 13/05* (2013.01)

(58) Field of Classification Search
None
See application file for complete search history.

(56) References Cited

U.S. PATENT DOCUMENTS 7,467,970 B2 * 12/2008 Ikuta ..... H01R 12/592 439/496
7,618,282 B2 * 11/2009 Wu ..... H01R 12/592 439/496
9,252,529 B2 * 2/2016 Cho ..... H01R 13/5812

* cited by examiner

*Primary Examiner* — Ross N Gushi

(57) ABSTRACT

A connector for a flat flexible cable includes a cable housing and a contact having an elastic portion. The cable housing includes a first housing having a termination passage extending through the first housing and a second housing mated with the first housing. A flat conductor exposed in a window extending through an insulation material of the flat flexible cable is held between the first housing and the second housing. The elastic portion extends through the termination passage and elastically bears against the flat conductor to electrically connect the contact to the flat conductor.

22 Claims, 10 Drawing Sheets

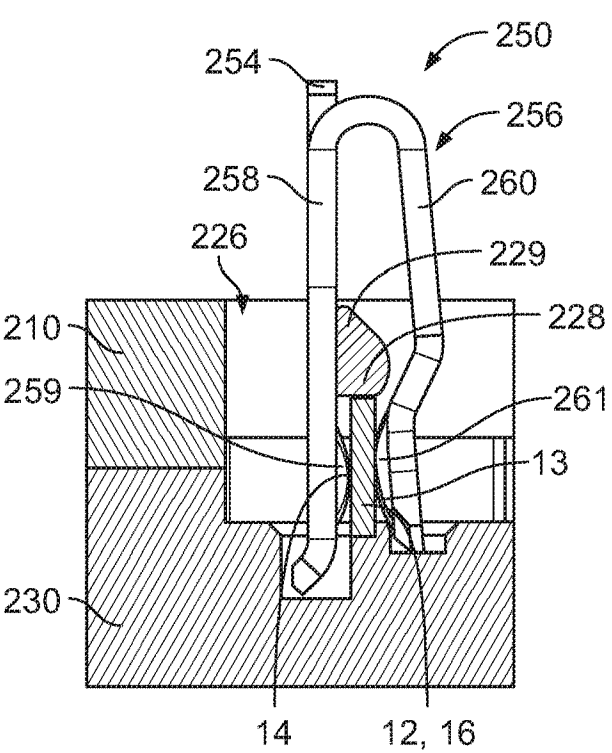
Fig. 7C
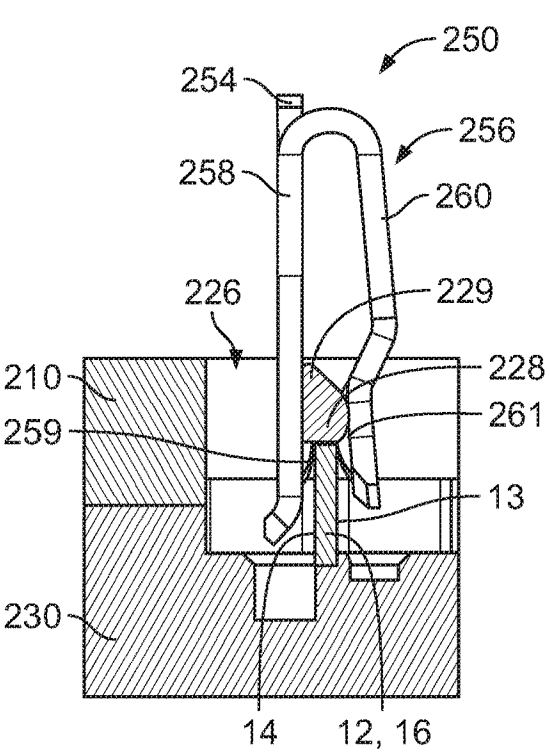
Fig. 7B
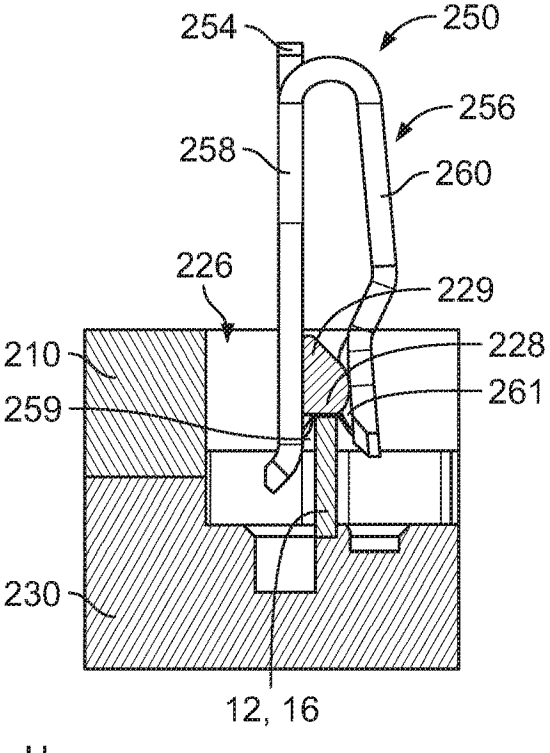
Fig. 7A
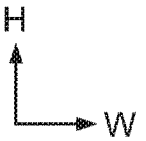

CONNECTOR FOR A FLAT FLEXIBLE CABLE

FIELD OF THE INVENTION

The present disclosure relates to a connector and, more particularly, to a connector for a flat flexible cable.

BACKGROUND

As understood by those skilled in the art, flat flexible cables (FFCs) or flat flexible circuits are electrical components consisting of at least one conductor (e.g., a metallic foil conductor) embedded within a thin, flexible strip of insulation. Flat flexible cables are gaining popularity across many industries due to advantages offered over their traditional "round wire" counter parts. Specifically, in addition to having a lower profile and lighter weight, FFCs enable the implementation of large circuit pathways with significantly greater ease compared to round wire-based architectures. As a result, FFCs are being considered for many complex and/or high-volume applications, including wiring harnesses, such as those used in automotive manufacturing.

The implementation or integration of FFCs into existing wiring environments is not without significant challenges. In an automotive application, by way of example only, an FFC-based wiring harness would be required to mate with perhaps hundreds of existing components, including sub-harnesses and various electronic devices (e.g., lights, sensors, etc.), each having established, and in some cases standardized, connector or interface types. Accordingly, a critical obstacle preventing the implementation of FFCs into these applications includes the need to develop quick, robust, and low resistance termination techniques which enable an FFC to be connectorized for mating with these existing connections.

A typical FFC may be realized by applying insulation material to either side of a pre-patterned thin foil conductor, and bonding the sides together via an adhesive to enclose the conductor therein. Current FFC terminals include piercing-style crimp terminals, wherein sharpened tines of a terminal are used to pierce the insulation and adhesive material of the FFC in order to attempt to establish a secure electrical connection with the embedded conductor. In harsh environmental conditions, however, such a connection suffers from plastic creep and stress relaxation of the metal, leading to inconsistent electrical connectivity between the conductor and the terminal and mechanical unreliability over time.

SUMMARY

A connector for a flat flexible cable includes a cable housing and a contact having an elastic portion. The cable housing includes a first housing having a termination passage extending through the first housing and a second housing mated with the first housing. A flat conductor exposed in a window extending through an insulation material of the flat flexible cable is held between the first housing and the second housing. The elastic portion extends through the termination passage and elastically bears against the flat conductor to electrically connect the contact to the flat conductor.

BRIEF DESCRIPTION OF THE DRAWINGS

The invention will now be described by way of example with reference to the accompanying Figures, of which:

FIG. 7A is a sectional side view of a first step of inserting a contact into a connector housing of the connector assembly of FIG. 6;

FIG. 7B is a sectional side view of a second step of inserting the contact into the connector housing of the connector assembly of FIG. 6;

FIG. 7C is a sectional side view of a fully inserted state of the contact into the connector housing of the connector assembly of FIG. 6;

DETAILED DESCRIPTION OF THE EMBODIMENTS

Figure 1:
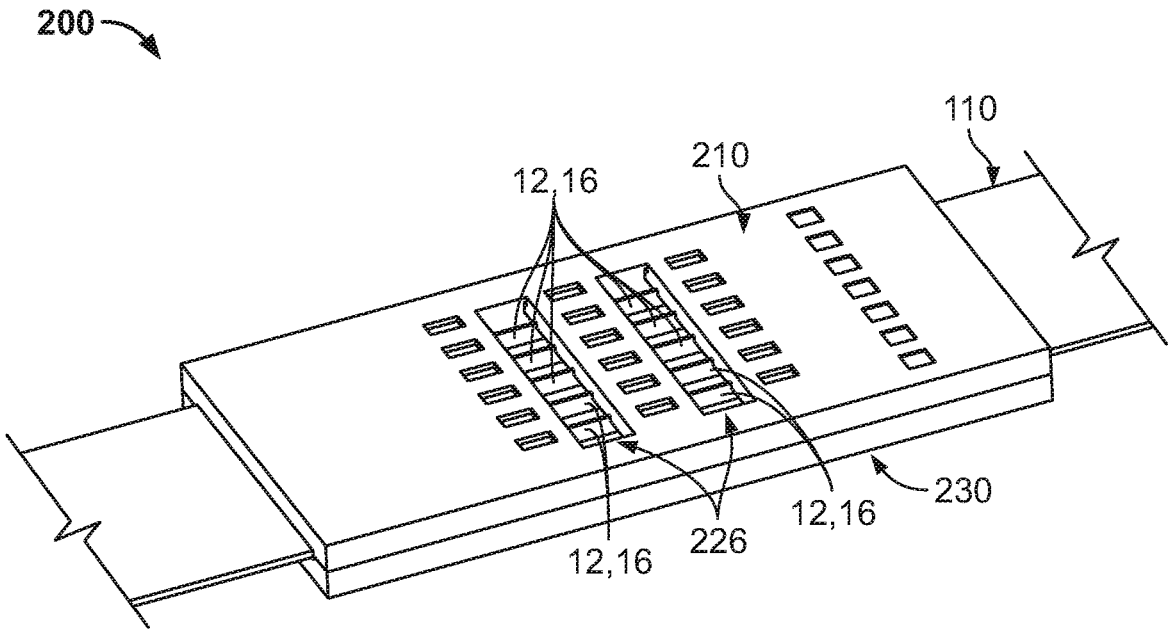
FIG. 1 is a perspective view of a contact housing and a flat flexible cable according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. In addition, in the following detailed description, for purposes of explanation, numerous specific details are set forth in order to provide a thorough understanding of the disclosed embodiments. However, it is apparent that one or more embodiments may also be implemented without these specific details.

A cable housing 200 according to an embodiment is shown attached to a flat flexible cable 10 in FIG. 1. The cable housing 200 includes a first housing 210 and a second housing 230 mated with and attached to the first housing 210. The flat flexible cable 10 is held between the first housing 210 and the second housing 230.

Figure 2:
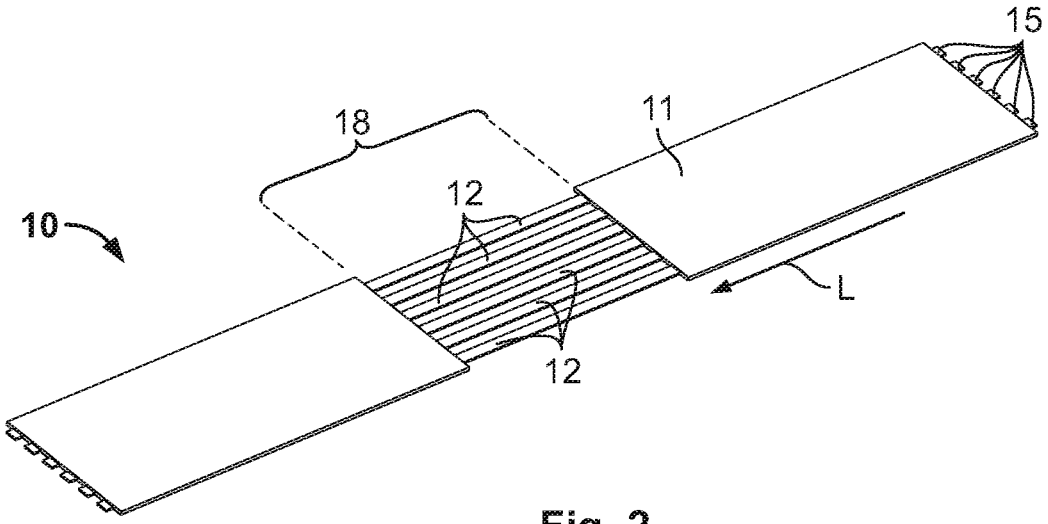
FIG. 2 is a perspective view of the flat flexible cable.

The flat flexible cable (FFC) 10 is shown in FIG. 2. The FFC 10 includes an insulation material 11 and a plurality of flat conductors 12 embedded in the insulation material 11. In an embodiment, the flat conductors 12 are each a metallic foil, such as a copper foil, by way of example only, patterned in any desirable configuration. The insulation material 11, such as a polymer insulation material, may be applied to either or both sides of the flat conductors 12 via an adhesive material or extruded directly over the flat conductors 12.

As shown in FIG. 2, the FFC 10 has a window 18 in which a portion of the insulation material 11 is removed. The flat conductors 12 are exposed in the window 18. In the shown embodiment, the window 18 extends through the insulation material 11 in a central portion of the FFC 10 along a longitudinal direction L. In other embodiments, the window 18 may extend through the insulation material 11 at an end of the FFC 10 along the longitudinal direction L, or anywhere else along the FFC 10 in the longitudinal direction L.

Figure 3:
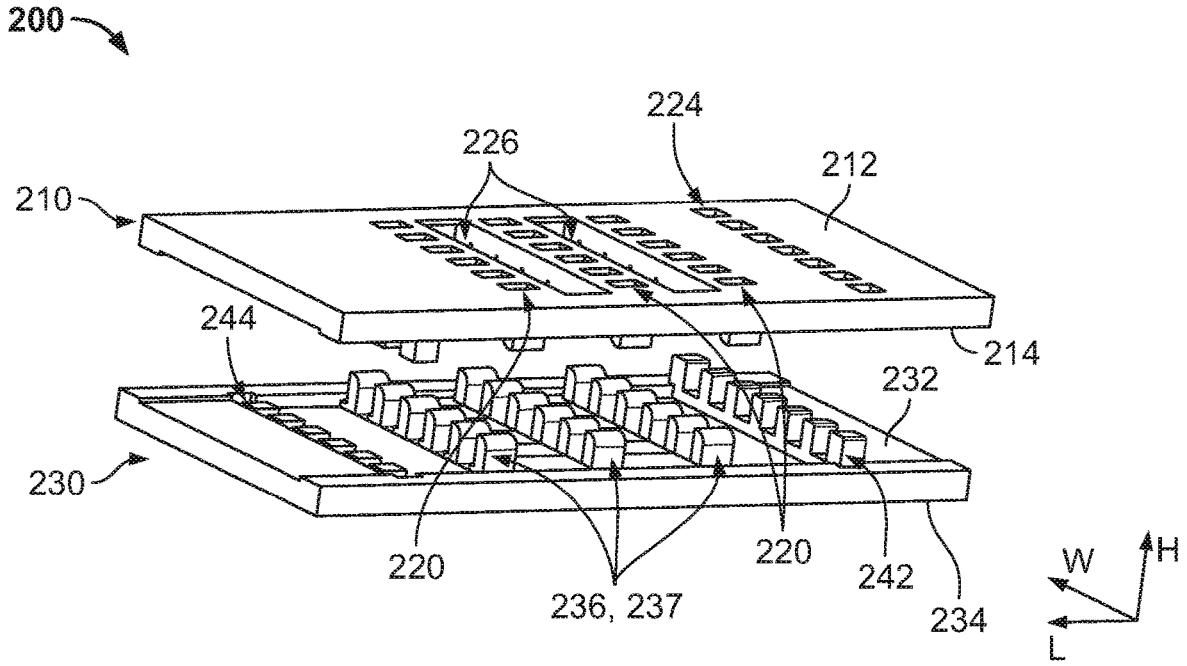
FIG. 3 is a top perspective view of a first housing and a second housing of the contact housing separated from one another.
Figure 4:
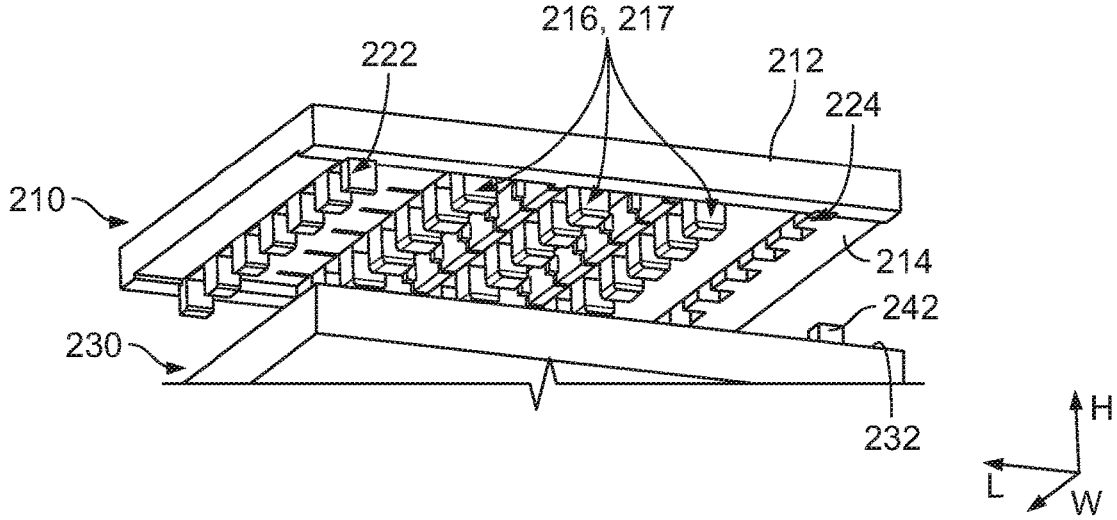
FIG. 4 is a bottom perspective view of the first housing and the second housing separated from one another.

The cable housing 200 is shown in FIGS. 3 and 4 with the first housing 210 separated from the second housing 230 along a height direction H perpendicular to the longitudinal direction L. In FIGS. 3 and 4, for some elements, a plurality of like elements described below as positioned in a row are labeled with a single arrow indicating all of the like elements in that row for clarity of the drawings.

The first housing 210 and the second housing 230 are each formed of an insulative material. In an embodiment, the first housing 210 and the second housing 230 are each monolithically formed in a single piece from the insulative material.

The first housing 210, as shown in FIGS. 3 and 4, has a first upper surface 212 and a first lower surface 214 opposite the first upper surface 212 in the height direction H. In the embodiment shown in FIGS. 3 and 4, the first housing 210 has an approximately rectangular shape along a plane defined by the longitudinal direction L and a width direction W perpendicular to both the longitudinal direction L and the height direction H.

The first housing 210, as shown in FIGS. 3 and 4, has a plurality of first orientation guides 216 and a plurality of first alignment posts 222 extending away from the first lower surface 214 along the height direction H.

In the embodiment shown in FIGS. 3 and 4, the first orientation guides 216 are arranged in a plurality of first rows 217 spaced apart from one another along the longitudinal direction L, with a plurality of first orientation guides 216 in each of the first rows 217. Each of the first rows 217 extends along the width direction W. In the shown embodiment, the first housing 210 has three first rows 217 with six first orientation guides 216 positioned in each of the first rows 217. The number of first orientation guides 216 corresponds to the number of flat conductors 12 in the FFC 10. In other embodiments, the first housing 210 may have only one first row 217, two first rows 217, or any number of first rows 217, and the number of first orientation guides 216 in each of the first rows 217 can range from one first orientation guide 216 to any number of first orientation guides 216.

Figure 5A:
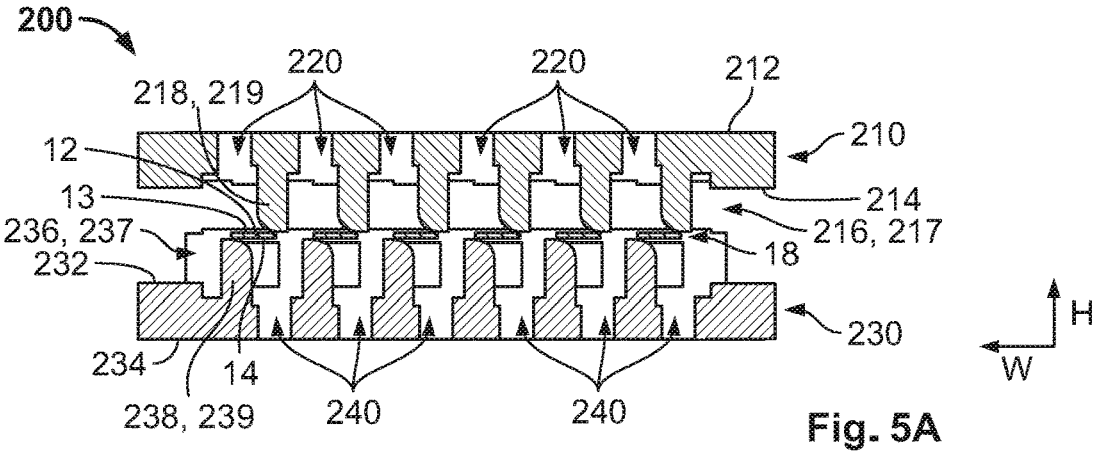
FIG. 5A is a sectional side view of a first step of mating the first housing with the second housing around flat conductors of the flat flexible cable.
Figure 5B:
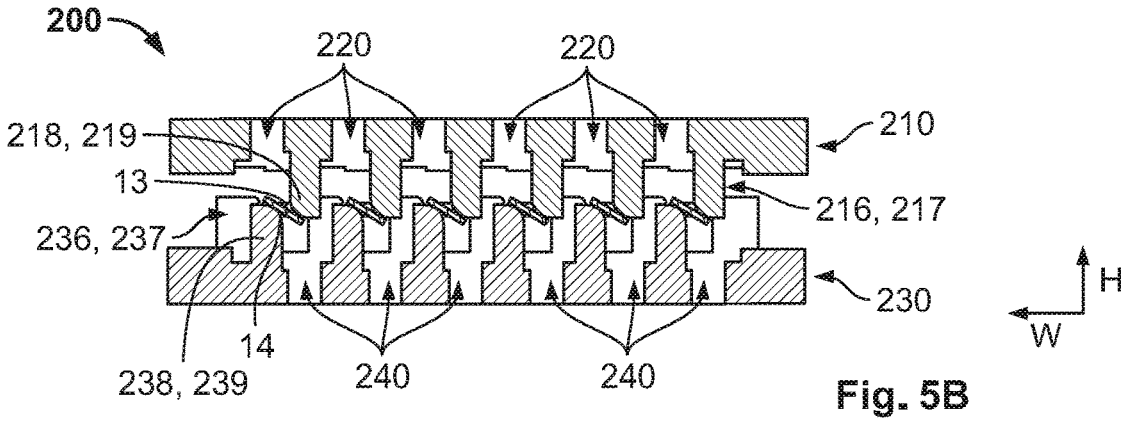
FIG. 5B is a sectional side view of a second step of mating the first housing with the second housing around the flat conductors.
Figure 5C:
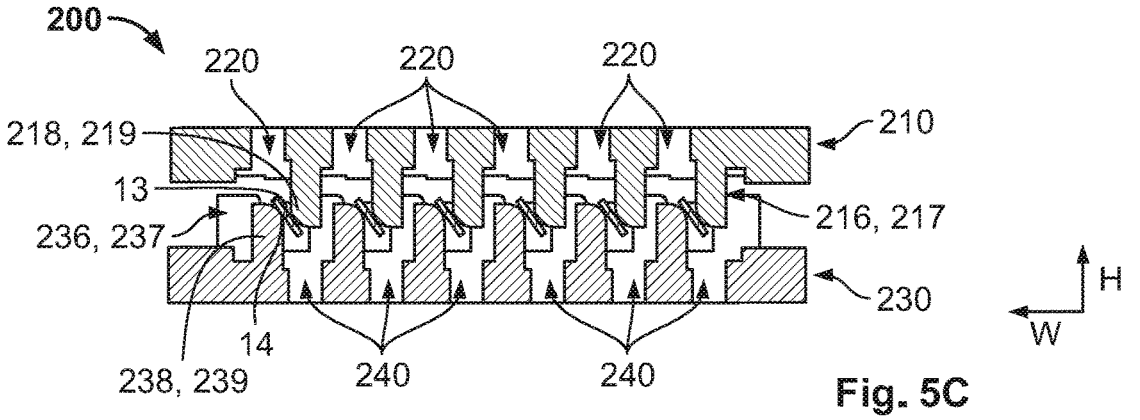
FIG. 5C is a sectional side view of a third step of mating the first housing with the second housing around the flat conductors.

The first orientation guides 216 are shown sectioned along one of the first rows 217 in the width direction W in FIGS. 5A-5D. As shown in FIGS. 5A-5C each of the first orientation guides 216 has a free end 218 positioned distal and opposite from the first lower surface 214 in the height direction H. The free end 218 has a first curved surface 219 on a side of the free end 218 in the width direction W. The free end 218 with the first curved surface 219 of only one of the first orientation guides 216 in the first row 217 is labeled in FIGS. 5A-5C for clarity of the drawings, however, each of the first orientation guides 216 in each of the first rows 217 has the free end 218 with the first curved surface 219.

The first alignment posts 222 extend from the first lower surface 214 in a single row in the width direction W, as shown in FIG. 4, and are evenly distributed along the single row. The first alignment posts 222 are spaced apart from the first orientation guides 216 in the first rows 217 in the longitudinal direction L. In the shown embodiment, the number of first alignment posts 222 positioned in the single row is greater than the number of first orientation guides 216 positioned in one of the first rows 217. In other embodiments, the number of first alignment posts 222 may less than or equal to the number of first orientation guides 216 in one of the first rows 217, and may be of any total number provided they are capable of performing the alignment functions described herein. In the shown embodiment, each of the first alignment posts 222 has an approximately square cross-section. In other embodiments, each of the first alignment posts 222 may have any shape that can fit into a complementary-shaped opening.

The first housing 210, as shown in FIGS. 3, 4, and 5A-5C, has a plurality of first orientation openings 220, a plurality of first alignment openings 224, and a plurality of termination passages 226 extending through the first housing 210 along the height direction H.

The first orientation openings 220, as shown in FIGS. 3 and 5A-5C, are positioned in the first rows 217 with the first orientation guides 216. One of the first orientation openings 220 is positioned in the width direction W between each pair of adjacent first orientation guides 216 in the first row 217; the first orientation guides 216 and the first orientation openings 220 are positioned in an alternating manner in the first row 217. The first orientation openings 220, in the shown embodiment, extend fully through the first housing 210 in the height direction H from the first lower surface 214 to the first upper surface 212. In another embodiment, the first orientation openings 220 may extend into the first lower surface 214 but be closed on the first upper surface 212.

The first alignment openings 224, as shown in FIGS. 3 and 4, are positioned in a single row in the width direction W and are evenly distributed along the single row. The first alignment openings 224 are spaced apart from the first orientation guides 216 in the first rows 217 and from the first alignment posts 222 in the longitudinal direction L. The first alignment openings 224 are positioned at an end of the first housing 210 opposite the first alignment posts 222 in the longitudinal direction L.

In the shown embodiment, the number of first alignment openings 224 positioned in the single row is greater than the number of first orientation guides 216 positioned in one of the first rows 217. In other embodiments, the number of first alignment openings 224 may be less than or equal to the number of first orientation guides 216 in one of the first rows 217, and may be of any total number provided they are capable of performing the alignment functions described herein. The first alignment openings 224, in the shown embodiment, extend fully through the first housing 210 in the height direction H from the first lower surface 214 to the first upper surface 212. In another embodiment, the first alignment openings 224 may extend into the first lower surface 214 but be closed on the first upper surface 212. In the shown embodiment, each of the first alignment openings 224 has an approximately square cross-section. In other embodiments, each of the first alignment openings 224 may have any shape that can receive a complementary-shaped post.

The termination passages 226, as shown in FIG. 3, are each positioned between two adjacent first rows 217 of the first orientation guides 216 in the longitudinal direction L. The termination passages 226, in the shown embodiment, extend along the first rows 217 in the width direction W and extend through the first housing 210 from the first lower surface 214 to the first upper surface 212.

The second housing 230, as shown in FIG. 3, has a second upper surface 232 and a second lower surface 234 opposite the second upper surface 232 in the height direction H. In the embodiment shown in FIG. 3, the second housing 230 has an approximately rectangular shape along a plane defined by the longitudinal direction L and the width direction W.

The second housing 230, as shown in FIG. 3, has a plurality of second orientation guides 236 and a plurality of second alignment posts 242 extending away from the second upper surface 232 along the height direction H.

In the embodiment shown in FIG. 3, the second orientation guides 236 are arranged in a plurality of second rows 237 spaced apart from one another along the longitudinal direction L, with a plurality of second orientation guides 236 in each of the second rows 237. Each of the second rows 237 extends along the width direction W. In the shown embodiment, the second housing 230 has three second rows 237 with six second orientation guides 236 positioned in each of the second rows 237. The number of second orientation guides 236 corresponds to the number of orientation guides 216 and the number of flat conductors 12 in the FFC 10. In other embodiments, the second housing 230 may have only one second row 237, two second rows 237, or any number of second rows 237, and the number of second orientation guides 236 in each of the second rows 237 can range from one second orientation guide 236 to any number of second orientation guides 236.

The second orientation guides 236 are shown sectioned along one of the second rows 237 in the width direction W in FIGS. 5A-5D. As shown in FIGS. 5A-5C, each of the second orientation guides 236 has a free end 238 positioned distal and opposite from the second upper surface 232 in the height direction H. The free end 238 has a second curved surface 239 on a side of the free end 238 in the width direction W. The free end 238 with the second curved surface 239 of only one of the second orientation guides 236 in the second row 237 is labeled in FIGS. 5A-5C for clarity of the drawings, however, each of the second orientation guides 236 in each of the second rows 237 has the free end 238 with the second curved surface 239.

The second alignment posts 242 extend from the second upper surface 232 in a single row in the width direction W, as shown in FIG. 3, and are evenly distributed along the single row. The second alignment posts 242 are spaced apart from the second orientation guides 236 in the second rows 237 in the longitudinal direction L. In the shown embodiment, the number of second alignment posts 242 positioned in the single row is greater than the number of second orientation guides 236 positioned in one of the second rows 237. In other embodiments, the number of second alignment posts 242 may less than or equal to the number of second orientation guides 236 in one of the second rows 237, and may be of any total number provided they are capable of performing the alignment functions described herein. In the shown embodiment, each of the second alignment posts 242 has an approximately square cross-section. In other embodiments, each of the second alignment posts 242 may have any shape, provided it is complementary to the first alignment openings 224.

The second housing 230, as shown in FIGS. 3 and 5A-5C, has a plurality of second orientation openings 240 and a plurality of second alignment openings 244 extending through the second housing 230 along the height direction H.

The second orientation openings 240, as shown in FIGS. 5A-5C, are positioned in the second rows 237 with the second orientation guides 236. One of the second orientation openings 240 is positioned in the width direction W between each pair of adjacent second orientation guides 236 in the second row 237; the second orientation guides 236 and the second orientation openings 240 are positioned in an alternating manner in the second row 237. The second orientation openings 240, in the shown embodiment, extend fully through the second housing 230 in the height direction H from the second lower surface 234 to the second upper surface 232. In another embodiment, the second orientation openings 240 may extend into the second upper surface 232 but be closed on the second lower surface 234.

The second alignment openings 244, as shown in FIG. 3, are positioned in a single row in the width direction W and are evenly distributed along the single row. The second alignment openings 244 are spaced apart from the second orientation guides 236 in the second rows 237 and from the second alignment posts 242 in the longitudinal direction L. The second alignment openings 244 are positioned at an end of the second housing 230 opposite the second alignment posts 242 in the longitudinal direction L.

In the shown embodiment, the number of second alignment openings 244 positioned in the single row is greater than the number of second orientation guides 236 positioned in one of the second rows 237. In other embodiments, the number of second alignment openings 244 may be less than or equal to the number of second orientation guides 236 in one of the second rows 237, and may be of any total number provided they are capable of performing the alignment functions described herein. The second alignment openings 244, in the shown embodiment, extend fully through the second housing 230 in the height direction H from the second lower surface 234 to the second upper surface 232. In another embodiment, the second alignment openings 244 may extend into the second lower surface 234 but be closed on the second upper surface 232. In the shown embodiment, each of the second alignment openings 244 has an approximately square cross-section. In other embodiments, each of the second alignment openings 244 may have any shape, provided it is complementary to the first alignment posts 222.

The assembly of the cable housing 200 with the FFC 10 will now be described in greater detail primarily with reference to FIGS. 5A-5D.

The window 18 of the FFC 10 is positioned between the first housing 210 and the second housing 230 in the height direction H, with the first housing 210 and the second housing 230 separated from one another along the height direction H as shown in FIG. 5A. The first orientation guides 216 are each aligned with one of the second orientation openings 240 in the height direction H and the second orientation guides 236 are each aligned with one of the first orientation openings 220 in the height direction H.

The flat conductors 12 exposed in the window 18 are positioned with a first surface 13 of each flat conductor 12 facing the first housing 210 and a second surface 14 of each flat conductor 12 opposite the first surface 13 facing the second housing 230. Only one of the flat conductors 12 is labeled with reference numbers in FIGS. 5A-5D for clarity of the drawings, but the description applies equally to each of the flat conductors 12 shown in FIGS. 1 and 5A-5D.

In a state of the FFC 10 shown in FIGS. 2 and 5A, the flat conductors 12 extend in a single plane throughout the insulation material 11 and in the window 18. The first surface 13 and the second surface 14 of the flat conductors 12, in both the insulation material 11 and in the window 18, are parallel with an upper surface and a lower surface of the insulation material 11 in the state shown in FIGS. 2 and 5A.

The first housing 210 is progressively moved toward the second housing 230 in the height direction H to mate with the second housing 230, as shown in FIGS. 5B and 5C. As the first housing 210 is moved toward the second housing 230, the first curved surface 219 of each of the first orientation guides 216 contacts the first surface 13 of one of the flat conductors 12 and the second curved surface 239 of each of the second orientation guides 236 contacts the second surface 14 of one of the flat conductors 12. As the first orientation guides 216 move into the second orientation openings 240 and the second orientation guides 236 move into the first orientation openings 220, the flat conductors 12 are rotated about the longitudinal direction L by interaction with the first curved surface 219 and the second curved surface 239.

Figure 5D:
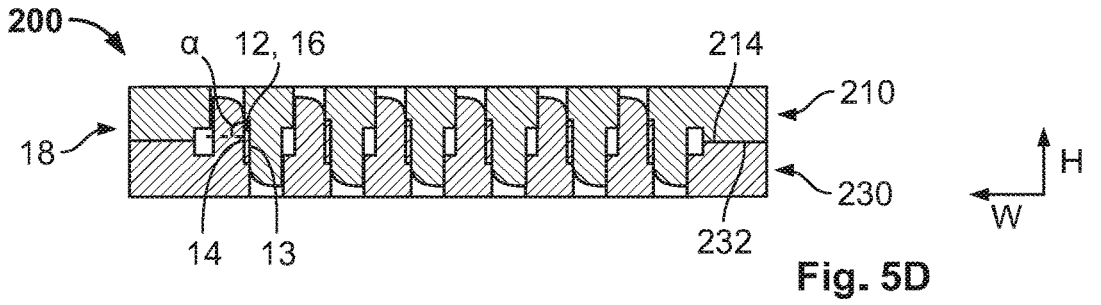
FIG. 5D is a sectional side view of a fully mated state of the first housing with the second housing around the flat conductors.

The cable housing 200 is shown in FIGS. 1 and 5D in a fully mated position of the first housing 210 with the second housing 230. In the fully mated position, the first lower surface 214 abuts the second upper surface 232. The first orientation guides 216 have been fully inserted into the second orientation openings 240 and the second orientation guides 236 have been fully inserted into the first orientation openings 220. The orientation guides 216, 236 and orientation openings 220, 240 are not labeled in FIG. 5D for clarity of the drawing but are the same elements as shown in FIG. 5A-5C.

As shown in FIG. 5D, each of the flat conductors 12 is held between one of the first orientation guides 216 in each of the first rows 217 and one of the second orientation guides 236 in each of the second rows 237 in the width direction W. Due to the rotation caused by the first curved surface 219 and the second curved surface 239 during mating of the first housing 210 with the second housing 230, the flat conductors 12 in the mated position of the cable housing 200 have a rotated portion 16 in the window 18 held between the first housing 210 and the second housing 230. In a planar portion 15 of each of the flat conductors 12 in the insulation material 11, shown in FIG. 2, the first surface 13 and the second surface 14 remain parallel with an upper surface and a lower surface of the insulation material 11.

The rotated portion 16, as shown in FIG. 5D, has a rotated orientation disposed at an angle $\alpha$ with respect to the planar portion 15, which extends along a plane defined by the width direction W and the longitudinal direction L. In the shown embodiment, the angle $\alpha$ is approximately 90° and the rotated portion 16 has an approximately perpendicular orientation to the planar portion 15. In other embodiments, for example with flat conductors 12 of different width and thickness than in the shown embodiment, the angle $\alpha$ may be between 45° and 90°. In the fully mated state shown in FIGS. 1 and 5D, the rotated portion 16 of each of the flat conductors 12 is exposed in each of the termination passages 226 of the first housing 210.

While the first housing 210 is moved toward the second housing 230 along the height direction H, the plurality of first alignment posts 222 move into the plurality of second alignment openings 244 and the plurality of second alignment posts 242 move into the first alignment openings 224. The interaction of the alignment posts 222, 242 with the alignment openings 224, 244 secures the alignment of the first housing 210 with respect to the second housing 230 in the mating process shown in FIGS. 5A-5D, to the fully mated state shown in FIG. 1.

A connector assembly 1 according to an embodiment, as shown in FIGS. 6 and 7A-7C, comprises the FFC 10 and a connector 20 connected to the FFC 10. The connector 20 includes the cable housing 200 and a contact 250. The FFC 10 is held in the cable housing 200 as shown in FIG. 1 and described in detail above; only the flat conductors 12 in the window 18 and held in the cable housing 200 are shown of the FFC 10 in FIGS. 6 and 7A-7C. The contact 250 is insertable into the cable housing 200 to electrically connect with the rotated portion 16 of the flat conductors 12.

Figure 6:
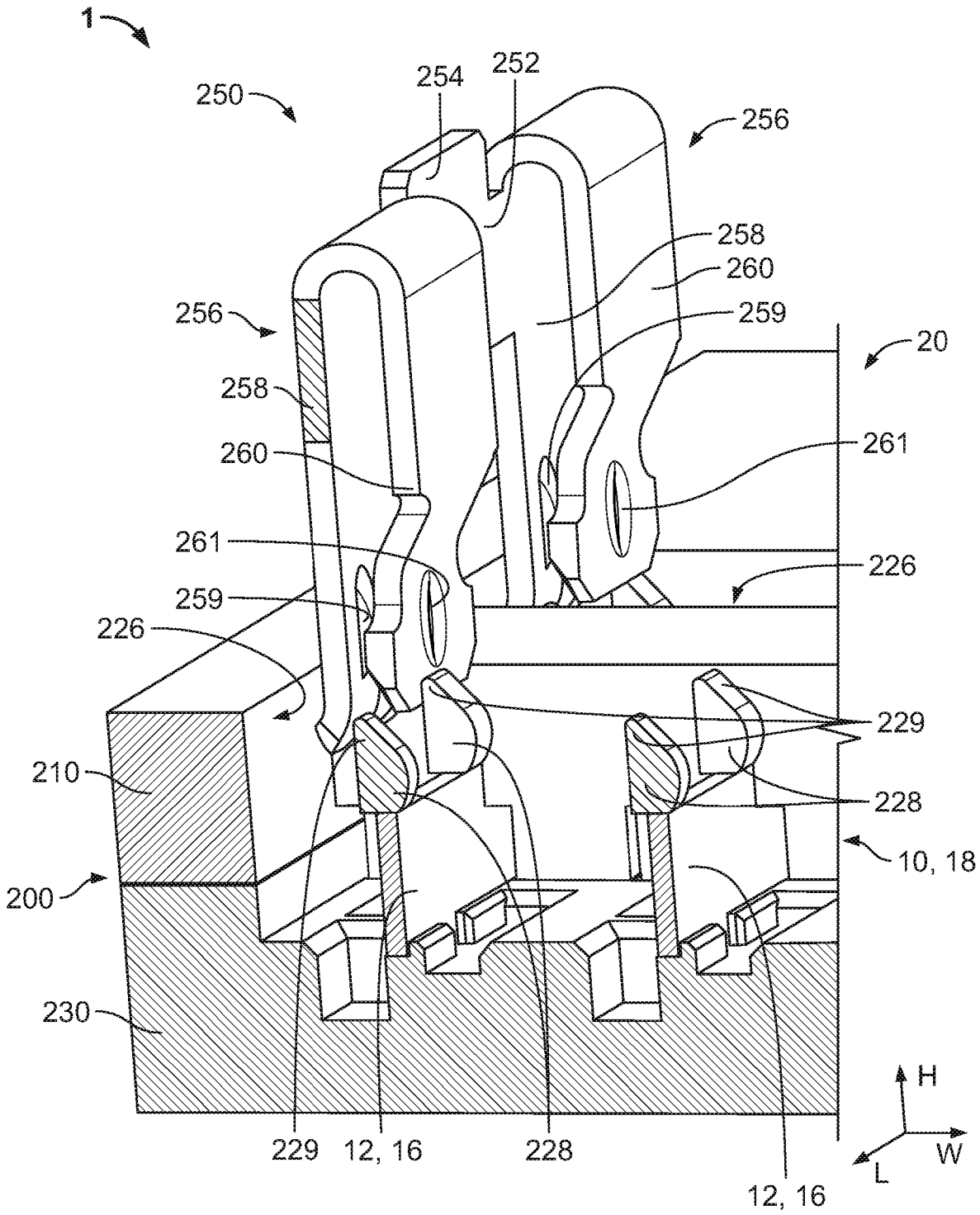
FIG. 6 is a sectional perspective view of a connector assembly according to an embodiment.

The contact 250, as shown in FIG. 6, has a base 252, a weld tab 254 extending from the base 252, and a pair of elastic portions 256 extending from the base 252 in a direction opposite the weld tab 254. In an embodiment, the contact 150 is monolithically formed in a single piece from a conductive material.

Figure 9:
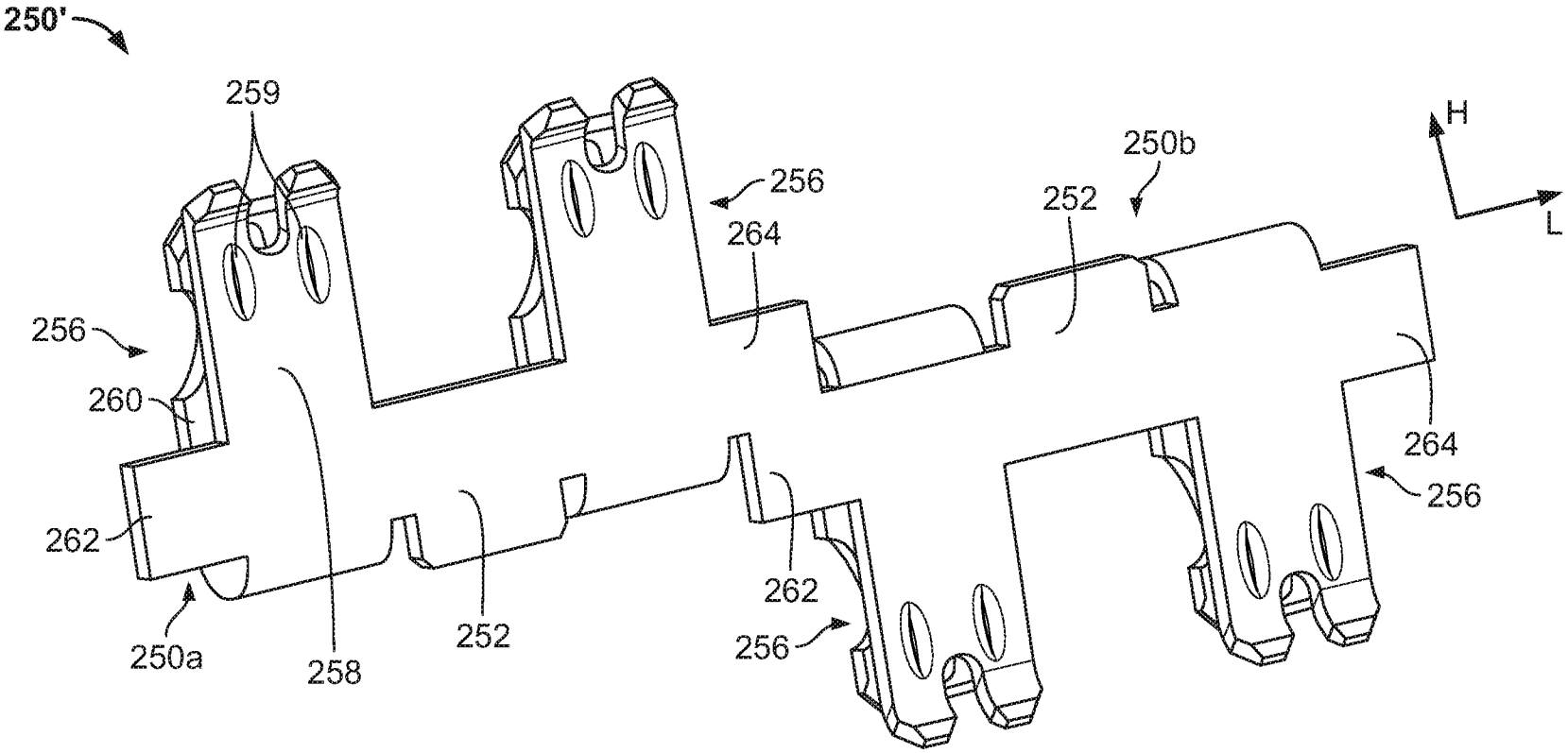
FIG. 9 is a perspective view of a contact of the connector assembly of FIG. 8.

Each of the elastic portions 256, as shown in FIGS. 6 and 7A-7C, is a pair of beams 258, 260 extending from the base 252 along the height direction H. The beams 258, 260 include a first beam 258 and a second beam 260 extending approximately parallel to the first beam 258. The first beam 258 has a pair of support nubs 259 at an end of the first beam 258 distal from the base 252. The pair of support nubs 259 are on a side of the first beam 258 facing the second beam 260 and protrude toward the second beam 260, as shown in FIGS. 7A-7C. The pair of support nubs 259 are also shown in FIG. 9. The second beam 260 has a contact nub 261 at an end of the second beam 260 distal from the base 252. The contact nub 261 is on a side of the second beam 260 facing the first beam 258 and protrudes toward the first beam 258, as shown in FIGS. 7A-7C. The contact nub 261 is aligned with the pair of support nubs 259 along the height direction H and is positioned between the pair of support nubs 258 along the longitudinal direction L.

With the cable housing 200 installed on the FFC 10 as shown in FIG. 1, the contact 250 is inserted into the cable housing 200 through the termination passages 226 as shown in FIGS. 6 and 7A-7C. As shown in FIG. 6, each of the elastic portions 256 is positioned over one of the termination passages 226. In embodiments of the cable housing 200 that have different numbers of termination passages 226 than in the shown embodiment, the number of elastic portions 256 of the contact 250 corresponds to the number of termination passages 226.

As shown in the embodiment of FIGS. 6 and 7A-7C, the first housing 210 has a plurality of protrusions 228 extending into the termination passages 226. The protrusions 228 extend from opposite sides of the termination passage 226 and each partially into the termination passage 226 in the longitudinal direction L. Each of the protrusions 228 has a tapered shape with a minimum thickness at an upper end 229 in the height direction H. In the shown embodiment, one protrusion 228 extends from each side of the termination passage 226 over the rotated portion 16 of each of the flat conductors 12. In other embodiments, the protrusions 228 could be arranged differently and in different numbers provided they affect insertion of the contact 250 as described herein.

From the position shown in FIG. 6, the elastic portion 256 is inserted into the termination passage 226 until the first beam 258 and the second beam 260 contact the upper ends 229 of the protrusions 228. As the elastic portion 256 is further inserted along the height direction H, the second beam 260 elastically deflects away from the first beam 258 in the width direction W due to the tapered shape of the protrusions 228, as shown in FIG. 7A, separating the support nubs 229 and the contact nub 261. The pair of support nubs 259 and the contact nub 261 are positioned between the protrusions 228 in the longitudinal direction L and, in the shown embodiment, do not contact the protrusions 228.

The support nubs 259 and the contact nub 261 first contact the rotated portion 16 of the flat conductor 12 in the position shown in FIG. 7B. In this position, a gap between the support nubs 259 and the contact nub 261 is slightly smaller than a width of the rotated portion 16 in the width direction W. Consequently, the support nub 259 and the contact nub 261 each apply a normal force largely on the first surface 13 and the second surface 14 of the flat conductor 12, preventing damage to an upper end of the flat conductor 12 in the height direction H.

During further insertion of the elastic portion 256 in the height direction H from the position shown in FIG. 7B to a fully inserted position shown in FIG. 7C, the support nub 259 and the contact nub 261 wipe the first surface 13 and the second surface 14 of the flat conductor 12. The second beam 260 moves off of the protrusion 228 and elastically returns to apply the normal force on the first surface 13.

In the fully inserted position shown in FIG. 7C, the elastic portion 256 extends through the termination passage 226 and elastically bears against the rotated portion 16 to electrically connect the contact 250 to the flat conductor 12. The direct contact between the elastic portion 256 and the flat conductor 12, with no intervening insulative material, allows for a more stable and reliable electrical connection.

In the embodiment shown in FIGS. 6 and 7C, the weld tab 254 can then be welded to another electrically conductive element, for example, a contact tab of a printed circuit board. The weld tab 254 in the shown embodiment extends in the height direction H and can be used to form a welded connection perpendicular to the FFC 10. In another embodiment, the weld tab 254 can extend from an end of the base 252 in the longitudinal direction L and can be used to form a welded connection parallel to the FFC 10.

The insertion of one contact 250 to electrically connect with the rotated portion 16 of one of the flat conductors 12 has been described above with reference to FIGS. 6 and 7A-7C. The drawings and description apply likewise to additional contacts 250 forming an electrical connection with each of the flat conductors 12 of the FFC 10 through the termination passages 226 of the first housing 210.

In other embodiments, the protrusions 228 can be omitted and the elastic portion 256 can be slid onto the rotated portion 16 in the height direction H without being elastically separated first, still elastically bearing against the rotated portion 16 to electrically connect the contact 250 to the flat conductor 12.

Figure 8:
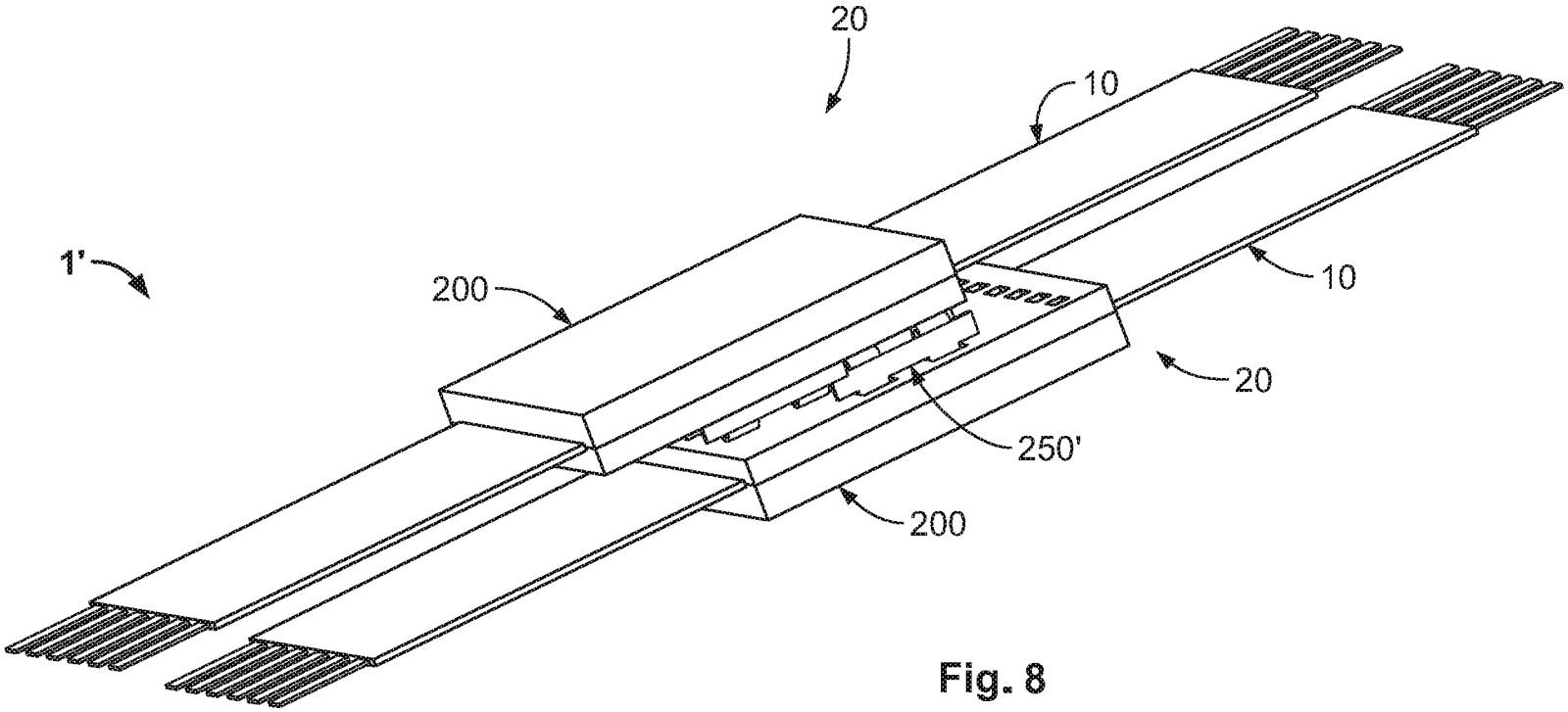
FIG. 8 is a perspective view of a connector assembly according to another embodiment.
Figure 10:
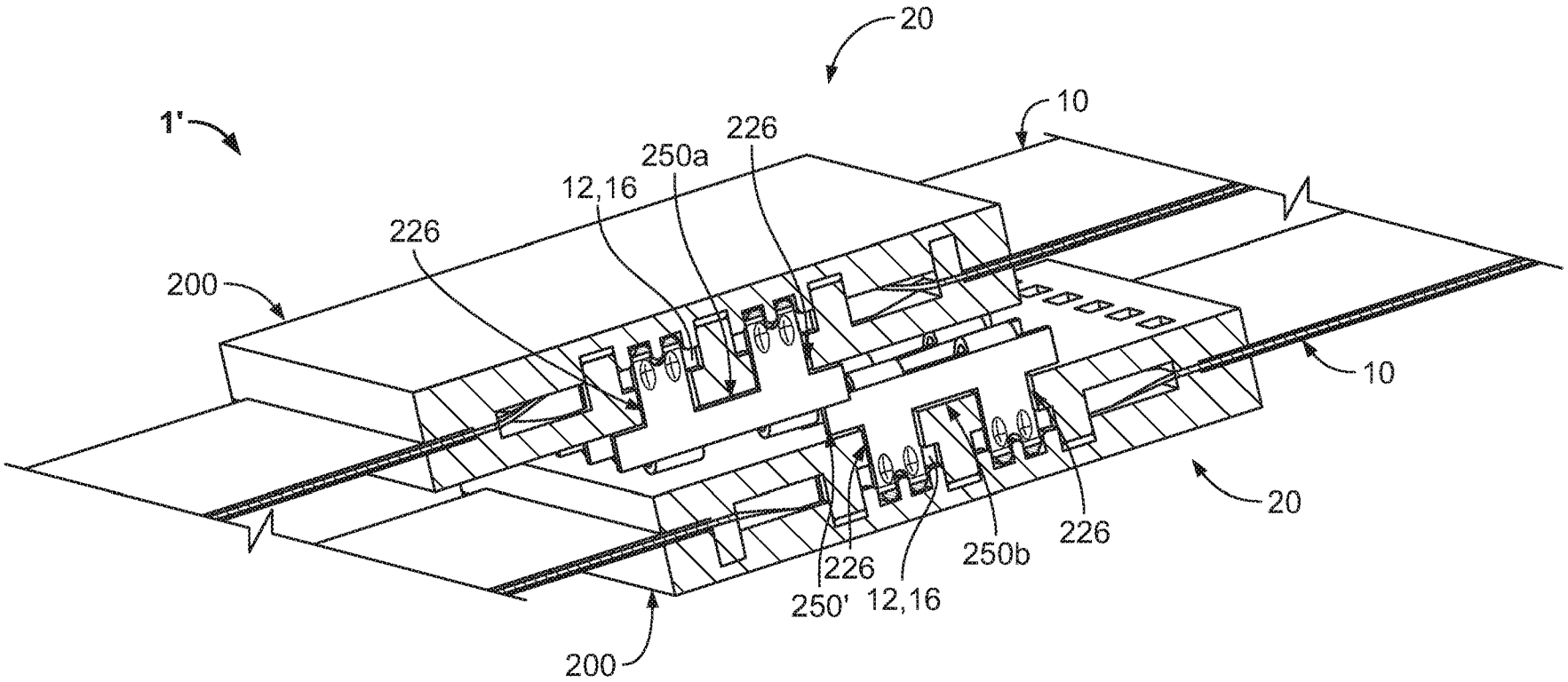
FIG. 10 is a sectional perspective view of the connector assembly of FIG. 8.

A connector assembly 1' according to another embodiment is shown in FIGS. 8-10. The connector assembly 1' includes a pair of FFCs 10 connected by a pair of connectors 20. The connector 20 includes the cable housing 200 and a contact 250'. In each of the connectors 20, the FFC 10 is held in the cable housing 200 as shown in FIG. 1 and described in detail above. The contact 250' is insertable into both of the cable housings 200 to electrically connect the rotated portion 16 of the flat conductors 12 of each of the FFCs 10.

The contact 250' is shown in FIG. 9. Like reference numbers refer to like elements with respect to the contact 250 shown in FIG. 6; the differences of the contact 250' with respect to the contact 250 will be primarily described herein.

As shown in the embodiment of FIG. 9, the contact 250' includes a pair of contacts 250*a*, 250*b* each similar to the contact 250 shown in FIG. 6. The contacts 250*a*, 250*b* are positioned adjacent to each other along the longitudinal direction L and connected to each other at the bases 252.

The base 252 of a first contact 250*a* of the pair of contacts 250*a*, 250*b* extends along the longitudinal direction L from a first end 262 to a second end 264. The base 252 of a second contact 250*b* of the pair of contacts 250*a*, 250*b* extends along the longitudinal direction L from a first end 262 to a second end 264. As shown in FIG. 9, the second end 264 of the first contact 250*a* is connected to the first end 262 of the second contact 250*b*. The elastic portions 256 of the first contact 250*a* extend in a direction opposite the elastic portions 256 of the second contact 250*b*. In an embodiment, the contact 250' is monolithically formed in a single piece from a conductive material. In another embodiments, the contacts 250*a*, 250*b* are attached to each other by any electrically conductive connection, such as a weld.

As shown in FIG. 10, the contact 250' is positioned between the cable housings 200 of each of the connectors 20. The first contact 250*a*, similarly to the insertion described above with respect to FIGS. 6 and 7A-7C, extends through the termination passages 226 of one of the cable housings 200 and contacts the rotated portion 16 of the flat conductor 12 of the FFC 10 connected to that cable housing 200. The second contact 250*b* likewise extends through the termination passages 226 of the other of the cable housings 200 and contacts the rotated portion 16 of the flat conductor 12 of the FFC 10 connected to that cable housing 200. In the connector assembly 1', the contact 250' electrically connects the FFCs 10 to each other.

Figure 11:
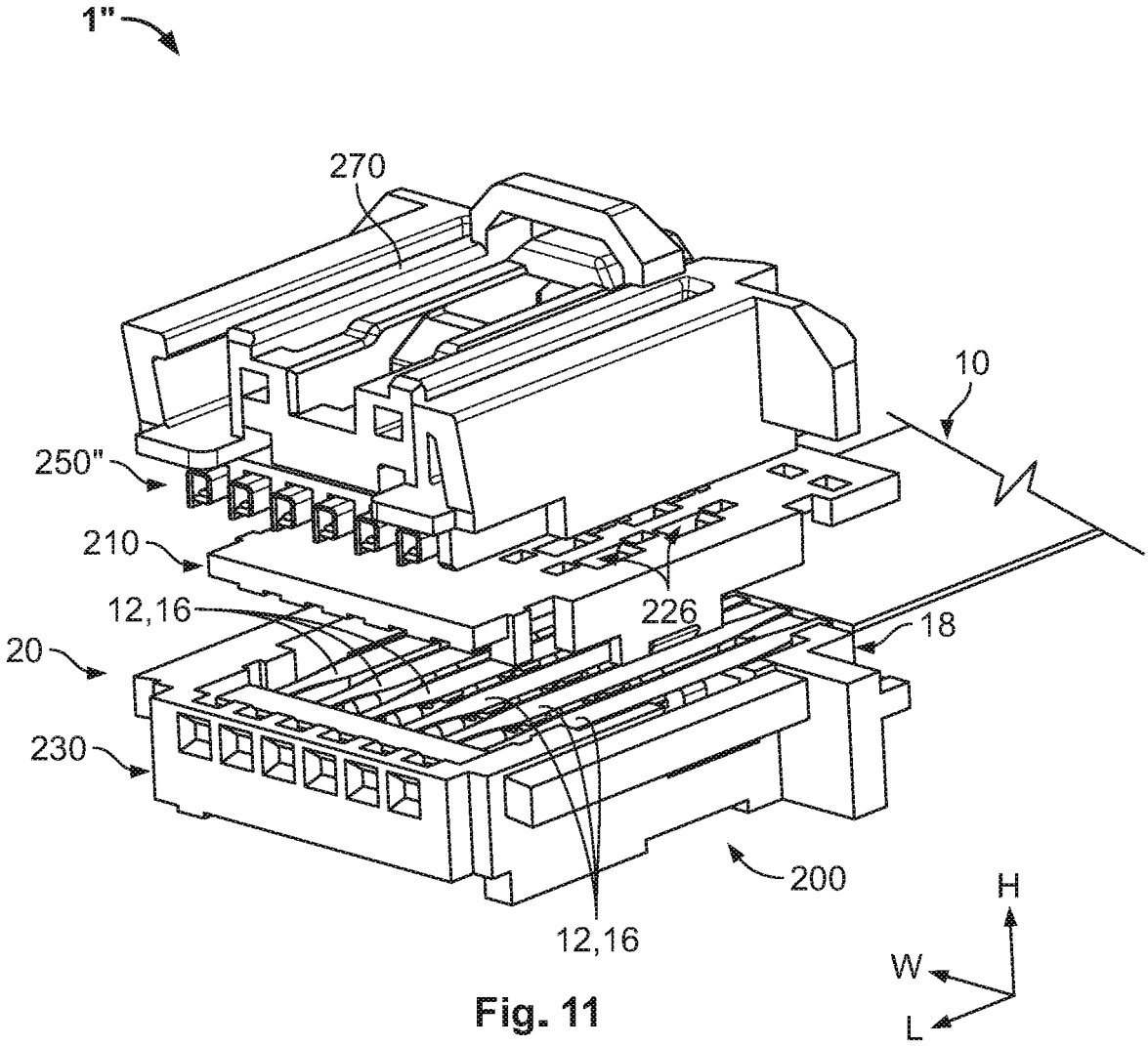
FIG. 11 is an exploded perspective view of a connector assembly according to another embodiment.
Figure 12:
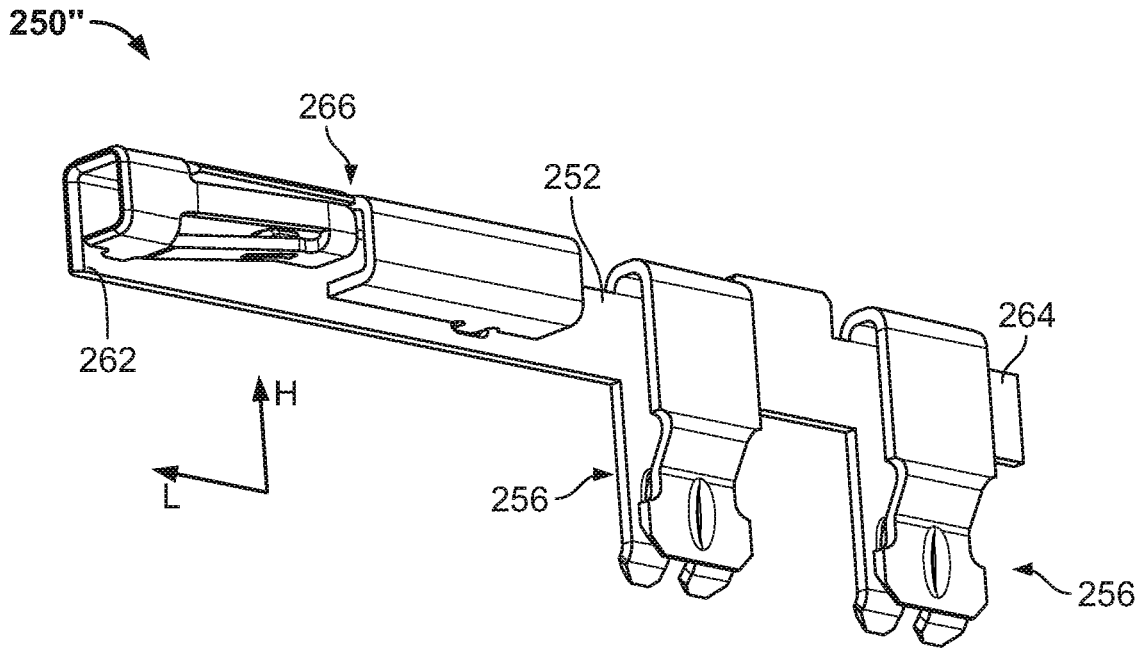
FIG. 12 is a perspective view of a contact of the connector assembly of FIG. 11.
Figure 13:
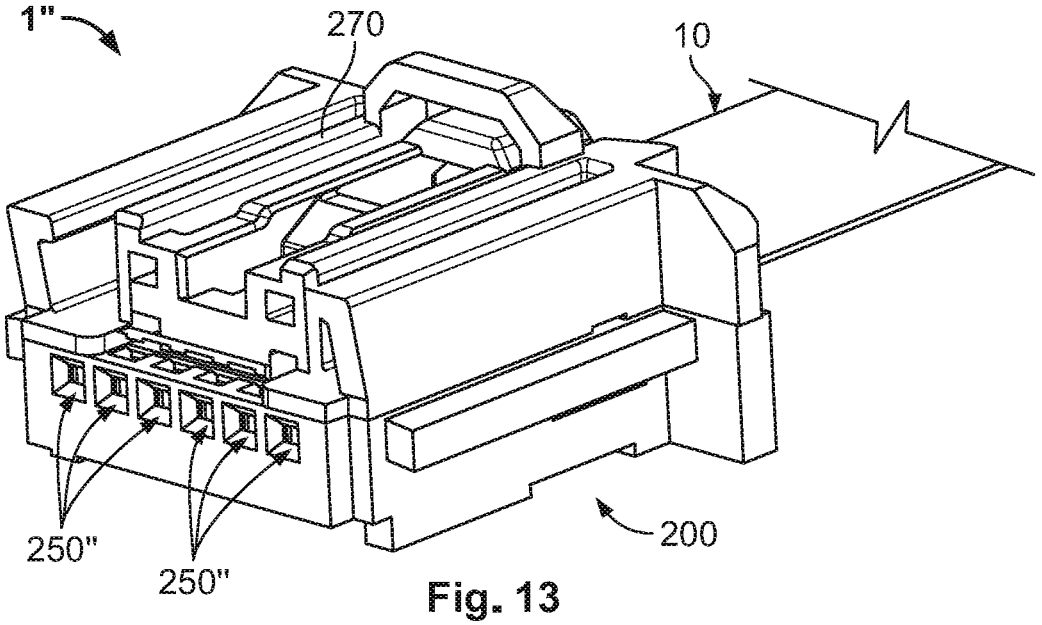
FIG. 13 is a perspective view of the connector assembly of FIG. 11.

A connector assembly 1" according to another embodiment is shown in FIGS. 11-13. The connector assembly 1" comprises the FFC 10 and a connector 20 connected to the FFC 10. The connector 20 includes the cable housing 200, a terminal housing 270, and a plurality of contacts 250" held between the cable housing 200 and the terminal housing 270. The FFC 10 is held in the cable housing 200 as shown in FIG. 1 and described in detail above. The cable housing 200 has a different shape in the embodiment of FIGS. 11-13 than in the embodiment shown in FIG. 1, however, all of the elements shown and described with respect to the embodiment of FIG. 1 are present and function identically in the cable housing 200 of FIGS. 11-13.

In the embodiment shown in FIGS. 11 and 13, the window of the FFC 10 is positioned at an end of the FFC 10 in the longitudinal direction L. The connector 20 in the connector assembly 1" terminates an end of the FFC 10 instead of attaching to a central portion of the FFC 10 as shown in the embodiments of FIGS. 1-10.

The contact 250" is shown in FIG. 12. Like reference numbers indicate like elements with respect to the contact 250 shown in FIG. 6; the differences of the contact 250" with respect to the contact 250 will be primarily described herein.

As shown in FIG. 12, the contact 250" has the base 252 extending from a first end 262 to a second end 264 along the longitudinal direction L. The contact 250" has a terminal portion 266 disposed on the base 252 at the first end 262 and the elastic portions 256 extending from the base 252 in the height direction H at the second end 264. In the shown embodiment, the terminal portion 266 is a receptacle for receiving a pin. In another embodiment, the terminal portion 266 could be a pin adapted to be inserted into a complementary receptacle. In an embodiment, the contact 250" is monolithically formed in a single piece from a conductive material. In another embodiment, the elements of the contact 250" can be attached together by any electrically conductive connection, such as a weld.

To assemble the connector assembly 1", as shown in FIG. 11, the contacts 250" are positioned over the first housing 210. Similarly to the insertion described above with respect to FIGS. 6 and 7A-7C, the elastic portions 256 extend through the termination passages 226 and contact the rotated portion 16 of the flat conductors 12 of the FFC 10. Each of the contacts 250" is electrically connected to one of the flat conductors 12 and allows external electrical connection to the FFC 10 through mating contact with the terminal portion 266.

When the connector assembly 1" is fully assembled, as shown in FIG. 13, the terminal housing 270 is attached to the cable housing 200. The contacts 250" are held and secured between the terminal housing 270 and the cable housing 200.

What is claimed is:

1. A connector for a flat flexible cable, comprising:

a cable housing including a first housing having a termination passage extending through the first housing and a second housing mated with the first housing, a flat conductor exposed in a window extending through an insulation material of the flat flexible cable is held between the first housing and the second housing, the first housing has a first orientation guide extending from a first lower surface and the second housing has a second orientation guide extending from a second upper surface; and a contact having an elastic portion, the elastic portion extends through the termination passage and elastically bears against the flat conductor to electrically connect the contact to the flat conductor, the elastic portion bears against a rotated portion of the flat conductor, the rotated portion has a rotated orientation disposed at an angle with respect to a planar portion of the flat conductor in the insulation material, the rotated portion is held between the first orientation guide and the second orientation guide.

2. The connector of claim 1, wherein the first orientation guide and the second orientation guide rotate the rotated portion to the rotated orientation when the first housing is mated with the second housing.

3. The connector of claim 2, wherein the first orientation guide has a first curved surface at an end opposite the first lower surface and the second orientation guide has a second curved surface at an end opposite the second upper surface.

4. The connector of claim 3, wherein the first curved surface contacts a first surface of the flat conductor and the second curved surface contacts a second surface of the flat conductor opposite the first surface as the first housing is mated with the second housing.

5. The connector of claim 1, wherein the first housing has a first orientation opening extending through the first housing adjacent to the first orientation guide and the second housing has a second orientation opening extending through the second housing adjacent to the second orientation guide.

6. The connector of claim 5, wherein the first orientation guide extends into the second orientation opening and the second orientation guide extends into the first orientation opening.

7. The connector of claim 1, wherein the first housing has a first alignment post spaced apart from the first orientation guide along a longitudinal direction of the cable housing and extending into a second alignment opening of the second housing, and/or the second housing has a second alignment post spaced apart from the second orientation guide along the longitudinal direction and extending into a first alignment opening of the first housing.

8. A connector assembly, comprising:

a flat flexible cable having an insulation material and a plurality of flat conductors embedded in the insulation material, the plurality of flat conductors are exposed in a window extending through a portion of the insulation material, each of the flat conductors extends along a longitudinal direction and has a planar portion in the insulation material; and a connector including a cable housing and a plurality of contacts, the cable housing includes a first housing having a termination passage extending through the first housing and a second housing mated with the first housing, the flat conductors exposed in the window are held between the first housing and the second housing, each of the contacts has an elastic portion extending through the termination passage and elastically bearing against one of the flat conductors to electrically connect each of the contacts to one of the flat conductors, each of the flat conductors has a rotated portion held between the first housing and the second housing, the rotated portion has a rotated orientation disposed at an angle rotated about an axis of the longitudinal direction with respect to the planar portion.

9. The connector assembly of claim 8, wherein each of the contacts has a terminal portion disposed at a first end and the elastic portion disposed at a second end opposite the first end.

10. The connector assembly of claim 9, wherein the connector includes a terminal housing attached to the cable housing, the contacts are held between the terminal housing and the cable housing.

11. The connector assembly of claim 8, wherein each of the contacts has a base and the elastic portion is a pair of beams extending from the base.

12. The connector assembly of claim 11, wherein the pair of beams include a first beam having a pair of support nubs contacting a first surface of the one of the flat conductors and a second beam having a contact nub contacting a second surface of the one of the flat conductors opposite the first surface.

13. The connector assembly of claim 11, wherein the first housing has a protrusion extending into the termination passage, the pair of beams are elastically separated by the protrusion when the elastic portion is inserted into the termination passage.

14. The connector assembly of claim 11, wherein the base has a weld tab.

15. The connector assembly of claim 8, wherein each of the contacts has a base and the elastic portion is one of a pair of elastic portions extending in opposite directions from the base and electrically connecting a pair of flat flexible cables.

16. A cable housing for a flat flexible cable, comprising:

a first housing having a termination passage extending through the first housing and a first orientation guide extending from a first lower surface of the first housing; and a second housing mated with the first housing and having a second orientation guide extending from a second upper surface of the second housing, a flat conductor exposed in a window extending through an insulation material of the flat flexible cable has a rotated portion held between the first orientation guide and the second orientation guide, the first orientation guide abuts a first surface of the flat conductor and the second orientation guide abuts a second surface of the flat conductor opposite the first surface, the rotated portion has a rotated orientation disposed at an angle with respect to a planar portion of the flat conductor in the insulation material.

17. A connector for a flat flexible cable, comprising:

a cable housing including a first housing having a termination passage extending through the first housing and a second housing mated with the first housing, a flat conductor exposed in a window extending through an insulation material of the flat flexible cable is held between the first housing and the second housing, the first housing has a plurality of first orientation guides extending from a first lower surface in a plurality of first rows and the second housing has a plurality of second orientation guides extending from a second upper surface in a plurality of second rows; and a contact having an elastic portion, the elastic portion extends through the termination passage and elastically bears against the flat conductor to electrically connect the contact to the flat conductor, the elastic portion bears against a rotated portion of the flat conductor, the rotated portion has a rotated orientation disposed at an angle with respect to a planar portion of the flat conductor in the insulation material.

18. The connector of claim 17, wherein the rotated portion of each of a plurality of flat conductors of the flat flexible cable is held between one of the first orientation guides in each of the first rows and one of the second orientation guides in each of the second rows.

19. A connector assembly, comprising:

a flat flexible cable having an insulation material and a plurality of flat conductors embedded in the insulation material, the plurality of flat conductors are exposed in a window extending through a portion of the insulation material, each of the flat conductors has a planar portion in the insulation material; and a connector including a cable housing and a plurality of contacts, the cable housing includes a first housing having a termination passage extending through the first housing and a second housing mated with the first housing, the flat conductors exposed in the window are held between the first housing and the second housing, each of the contacts has an elastic portion extending through the termination passage and elastically bearing against one of the flat conductors to electrically connect each of the contacts to one of the flat conductors, each of the flat conductors has a rotated portion held between the first housing and the second housing, the rotated portion has a rotated orientation disposed at an angle with respect to the planar portion, each of the contacts has a base and the elastic portion is a pair of beams extending from the base, the pair of beams include a first beam having a pair of support nubs contacting a first surface of the one of the flat conductors and a second beam having a contact nub contacting a second surface of the one of the flat conductors opposite the first surface.

20. A connector assembly, comprising:

a flat flexible cable having an insulation material and a plurality of flat conductors embedded in the insulation material, the plurality of flat conductors are exposed in a window extending through a portion of the insulation material, each of the flat conductors has a planar portion in the insulation material; and a connector including a cable housing and a plurality of contacts, the cable housing includes a first housing having a termination passage extending through the first housing and a second housing mated with the first housing, the flat conductors exposed in the window are held between the first housing and the second housing, each of the contacts has an elastic portion extending through the termination passage and elastically bearing against one of the flat conductors to electrically connect each of the contacts to one of the flat conductors, each of the flat conductors has a rotated portion held between the first housing and the second housing, the rotated portion has a rotated orientation disposed at an angle with respect to the planar portion, each of the contacts has a base and the elastic portion is a pair of beams extending from the base, the first housing has a protrusion extending into the termination passage, the pair of beams are elastically separated by the protrusion when the elastic portion is inserted into the termination passage.

21. A connector assembly, comprising:

a flat flexible cable having an insulation material and a plurality of flat conductors embedded in the insulation material, the plurality of flat conductors are exposed in a window extending through a portion of the insulation material, each of the flat conductors has a planar portion in the insulation material; and a connector including a cable housing and a plurality of contacts, the cable housing includes a first housing having a termination passage extending through the first housing and a second housing mated with the first housing, the flat conductors exposed in the window are held between the first housing and the second housing, each of the contacts has an elastic portion extending through the termination passage and elastically bearing against one of the flat conductors to electrically connect each of the contacts to one of the flat conductors, each of the flat conductors has a rotated portion held between the first housing and the second housing, the rotated portion has a rotated orientation disposed at an angle with respect to the planar portion, each of the contacts has a base and the elastic portion is a pair of beams extending from the base, the base has a weld tab.

22. A connector assembly, comprising:

a flat flexible cable having an insulation material and a plurality of flat conductors embedded in the insulation material, the plurality of flat conductors are exposed in a window extending through a portion of the insulation material, each of the flat conductors has a planar portion in the insulation material; and a connector including a cable housing and a plurality of contacts, the cable housing includes a first housing having a termination passage extending through the first housing and a second housing mated with the first housing, the flat conductors exposed in the window are held between the first housing and the second housing, each of the contacts has an elastic portion extending through the termination passage and elastically bearing against one of the flat conductors to electrically connect each of the contacts to one of the flat conductors, each of the flat conductors has a rotated portion held between the first housing and the second housing, the rotated portion has a rotated orientation disposed at an angle with respect to the planar portion, each of the contacts has a base and the elastic portion is one of a pair of elastic portions extending in opposite directions from the base and electrically connecting a pair of flat flexible cables.

* * * * *